US007261051B2

(12) United States Patent
Tipaldo

(10) Patent No.: US 7,261,051 B2
(45) Date of Patent: Aug. 28, 2007

(54) CONDENSED RETRACTABLE SAFETY MARKER

(75) Inventor: John M. Tipaldo, 405 Beach 132 St., Belle Harbor, NY (US) 11694

(73) Assignee: John M. Tipaldo, Belle Harbor, NY (US)

( * ) Notice: Subject to any disclaimer, the term of this patent is extended or adjusted under 35 U.S.C. 154(b) by 0 days.

(21) Appl. No.: 11/097,576

(22) Filed: Apr. 4, 2005

(65) Prior Publication Data

US 2006/0219153 A1 Oct. 5, 2006

(51) Int. Cl.
*E01F 9/00* (2006.01)

(52) U.S. Cl. ..... 116/63 P; 116/63 R; 40/612

(58) Field of Classification Search ..... 116/63 C, 116/63 P, 63 T, 28 R, 173, 200; 40/608, 40/610, 612; 33/296, 809
See application file for complete search history.

(56) References Cited

U.S. PATENT DOCUMENTS 3,021,755 A * 2/1962 Karchenes ..... 248/472
3,234,903 A * 2/1966 Vara, Sr. ..... 116/63 P
3,520,273 A * 7/1970 Daifotes ..... 116/28 R
3,695,213 A * 10/1972 Littlefield ..... 116/28 R
3,732,842 A * 5/1973 Vara, Sr. ..... 116/63 P
4,090,468 A * 5/1978 D'Spain ..... 116/267
4,806,046 A * 2/1989 Clark ..... 404/10
6,508,195 B1 * 1/2003 Tipaldo ..... 116/63 P
6,681,715 B2 * 1/2004 Wood ..... 116/63 P
6,746,337 B1 * 6/2004 Tipaldo ..... 473/150
6,790,021 B2 * 9/2004 Dowling et al. ..... 425/11
6,971,329 B1 * 12/2005 Stewart ..... 116/63 C
7,007,630 B2 * 3/2006 Garcia ..... 116/63 C

* cited by examiner

*Primary Examiner*—G. Bradley Bennett
*Assistant Examiner*—Tania C Courson

(57) ABSTRACT

A condensed retractable traffic cone is a device designed to provide motorists with advance warning of disabled vehicles and/or work zone areas. The device has been designed to withstand reasonable winds through the use of two base supports, a lower portion, a retractable arm and a series of retractable vertical risers. The retractable vertical risers in combination with a retractable arm allow for the device to easily expand to height consistent with traffic engineering design standards when in operation and then compact when it is in storage. The two base supports are designed not only to provide the necessary structural stability but to also open and close about the retractable vertical risers thus providing for additional compactness. The vertical risers are designed with flexible hinges so that they may store flat and expand to a rectangular shape when the base supports are rotated to an open position. This is accomplished a by linkage connecting the lower vertical riser and the base supports.

2 Claims, 6 Drawing Sheets

CONDENSED RETRACTABLE SAFETY MARKER

BACKGROUND AND SUMMARY OF THE INVENTION

This application relates to means of altering motorists to the presence of disabled vehicles or work zone areas. Each year hundreds of motorists are either killed or injured along side the roadway. Many of these accidents may be prevented if the oncoming motorist had advance warning of the presence of these disabled vehicles. The present invention is an improvement or alternative to my prior U.S. Pat. No. 6,508,195.

In recent years, a variety of traffic warning devices have become known and reference may be had to the following U.S. patents for a description of these prior art of traffic warning devices; U.S. Pat. Nos. 6,508,195, 6,681,715, 2,954,005, 3,496,904, 4,006,702, 4,197,807, 4,256,50, 2,762,327, 3,132,624, 3,520,235, 4,462,145, 4,466,376, 6,971,329 B1, 6,746,337 B1, 4,806,046, 4,090,468, 3,732, 842, 3,695,213, 3,520,273, 3,234,903, 3,021,755 and 5,287, 822.

Over the years there have been many attempts to provide a retractable or collapsible traffic cone. Designs have spanned from sleeves of varying diameter and taper which when extended fit into one another and form a cone shaped marker (U.S. Pat. Nos. 2,954,005 and 3,496,904). Another variation of the concept is found in U.S. Pat. No. 2,762,327 where the device is inflatable and is attached to a solid base and filled with air when ready for use. Other designs have employed the varied use of coils or springs as a means of displaying the traffic control device. These devices are outlined in U.S. Pat. Nos. 4,006,702, 4,256,050, 4,197,807, 4,256,050 and 5,305,705.

Other designs have employed the use of springs and a flexible membrane (U.S. Pat. No. 3,132,624) and a two-piece center support member. U.S. Pat. No. 3,520,235 describes a device that requires assembly prior to use and employs a two-piece center support pole.

In other designs three and four sided panel fan shaped members (U.S. Pat. Nos. 4,466,376 and 4,462,145) are employed to form upright three and four sided triangles respectively.

While this has long been recognized as a traffic safety problem many needless deaths and injuries continue to happen every year. Current methods of enhancing motorist awareness includes; flares, solid plastic cones and collapsible or spring cones. While all devices may accomplish the same goal as the presented invention, the presented invention is designed to help eliminate current difficulties encountered with their use. With roadside flares there is the inherent short fall that they only last a given period of time and are not reusable. In addition, they are usually only several inches above the roadway service and may present difficulty in operating. Solid plastic cones are easy to place along the roadway however unless they are properly weighted and sized they may be displaced due to strong gusts of winds. In addition, the larger the cone the more storage space that is required. This is a disadvantage (especially in small passenger vehicles) and therefore reduces their attractiveness of the use. In recent years several collapsible or spring traffic cones have been introduced into the market place. The current invention is a significant improvement to these designs since the use of the flexible hinges on the vertical risers and the use of a rotating base support allows requires approximately ½ the necessary storage space. In addition, when compared to the designs that require springs (U.S. Pat. No. 5,305,705), the present invention is totally self-contained and does not require any additional locking mechanism when storing. The reduced storage space significantly increases the attractiveness of the present invention, especially in emergency response vehicles where space is at a premium.

The present invention is a variation of my prior U.S. Pat. No. 6,508,195 in that the porous casing is replaced by a series of vertical risers. The vertical risers may be described as a rectangular or trapezoidal shaped flexible "box" where the top and bottom sides are open. The vertical risers are designed to fit within each other and are designed with flexible hinges extending its entire length on each corner so that they may store relatively flat. In U.S. Pat. No. 6,508,195 two retractable arms are used as a means of expanding the porous casing from a compact to expanded position. In the present invention, the two retractable arms are replaced by a single retractable arm placed in the center of the lower portion as is used as a means of expanding the series of vertical risers from a compact to expanded position. As in U.S. Pat. No. 6,508,195 the base supports are connected to the lower portion by a series of protruding tabs and holes. In the present invention, the lower vertical riser is connected to the base supports by a lower linkage that allows the series of vertical risers to transform from a relatively flat position is storage to a rectangular shape when the base support goes from a closed to an open position when rotated about the lower portion. In addition, the upper vertical riser is also linked to the upper portion of the retractable arm. This upper linkage allows for the vertical risers to be lifted from a compact to expanded position when the retractable arm is fully expanded. In order to help accomplish this movement the upper portion of the retractable arm contains a handle.

The Condensed Retractable Traffic Cone has been designed to be employ easily, store compactly, withstand prevailing winds and be economical.

The Condensed Retractable Traffic Cone is a combination of several pieces. The first two pieces are referenced to as the base supports. The base supports are similar in design and function to the base supports disclosed in may prior U.S. Pat. No. 6,508,195. The base supports are connected to the lower portion in a similar manner as taught in my prior U.S. Pat. No. 6,508,195. Connected to the lower portion is single retractable arm with a handle on its upper portion. When the device is fully deployed the retractable arm is perpendicular to the base supports. When the device is in storage the retractable arm is parallel to the base supports. In the present invention the porous casing taught in U.S. Pat. No. 6,508, 195 is replaced by a series of vertical risers. Each vertical riser is designed with hinges along each corner that extend its entire length. This design allows for the vertical rises to be able to change shape when pressure is applied. The vertical risers are designed to fit within each other and may either be rectangular or slightly tapered. In order to reduce wind load on the sign support structure, the each vertical riser may be designed with "air-flow" holes. Also the bottom portion of the retractable arm may be designed in the shape of a spring that would allow for the slight deflection of the present invention when subject to high wind loads. Allowing for this slight deflection may reduce the overall weight of the device thereby potentially reducing its cost.

In addition, reflective decals may be affixed to the vertical risers to correspond with traffic control device design standards. The actual number of vertical risers employed depends on application.

The two base supports are intended to provide the necessary weight to ensure that the device is not displaced under reasonable wind loads. Similar to U.S. Pat. No. 6,508,195, each base support also has several strategically placed tabs. The base support is primarily a rectangular type box with the top end and one of the sides open. The long sides of the base support contain a tab at the "open" end of the box. These tabs are designed to allow the base support to be affixed to holes in the lower portion. Similar to U.S. Pat. No. 6,508,195, the lower portion has been designed with "protruding" tabs.

The Condensed Retractable Traffic Cone has been designed for easy placement during emergency situations. The first step in the application process is to rotate the two base supports from the closed to the open position and locked (parallel with the lower portion). After the base support is fixed in the open position, the series of vertical risers is then expanded by simply pulling in a vertical manner the handle on the upper portion of the retractable arm. This is continued until all the vertical risers are in fully extended position. At this point the invention is ready for application.

The present invention offers an improvement over the previous designs in that the base support has been designed to fold in half thereby significantly reducing the necessary storage space when compared to similar sized designs. Through the use of "hinged" vertical risers that store effectively "flat" when not in operation and then "open" when in operation, significantly also reduces the necessary storage space when compared to devices that use a rigid sleeve design. This improved storage efficiency in both the base support and the vertical risers increases the attractiveness of the present invention to the user since it requires significantly less storage space when compare to the current state of the art. This is especially essential when the users are the highway motorcycle patrol or motorcyclists in general. The present invention has been designed to fit into the side compartment of their motorcycle. This is envisioned as a primary application for the present invention.

In addition when compared to spring or coil type devices the present invention does not require any additional "locking" mechanism. Also when compared to some previous designs the present invention is totally "self-contained" and requires no assembly prior to implementation.

Further, the device has been designed so that "reflective decals" can be directly affixed to the device to alert motorists. Several other designs, especially those that require the use of a spring or a coil require the use of a "flexible reflective material". "Reflective decals" (similar to those used on existing traffic control devices) are usually brittle and would crack when stored in a compressed position, therefore they would not be recommended for many of the previously discussed prior designes. "Reflective tape" may also be used in many of the previously disclosed designed. While less brittle than "decals" they have a problem with wrinkling when compressed. A primary benefit of the use of reflective "decals" or "tape" is the reduced cost when compared to "collars" currently used on rigid traffic cones and on several existing "collapsible" devices.

BRIEF DESCRIPTION OF THE DRAWINGS

The subject matter which is regarded as the present invention is particularly pointed out and distinctly claimed in the concluding portion of the specification. The invention, however, both as to organization and method of practice, may be best understood by reference to the detailed description, taken in conjunction with the accompanying drawings, in which:

DETAILED DESCRIPTION

Reference will now be made to the drawings in which the various elements of the present invention will be given numerical designations. In its present form the invention consists of several distinct elements. These elements when combined as described within will allow one of ordinary skill in the art to made and use the present invention.

Figure 1:
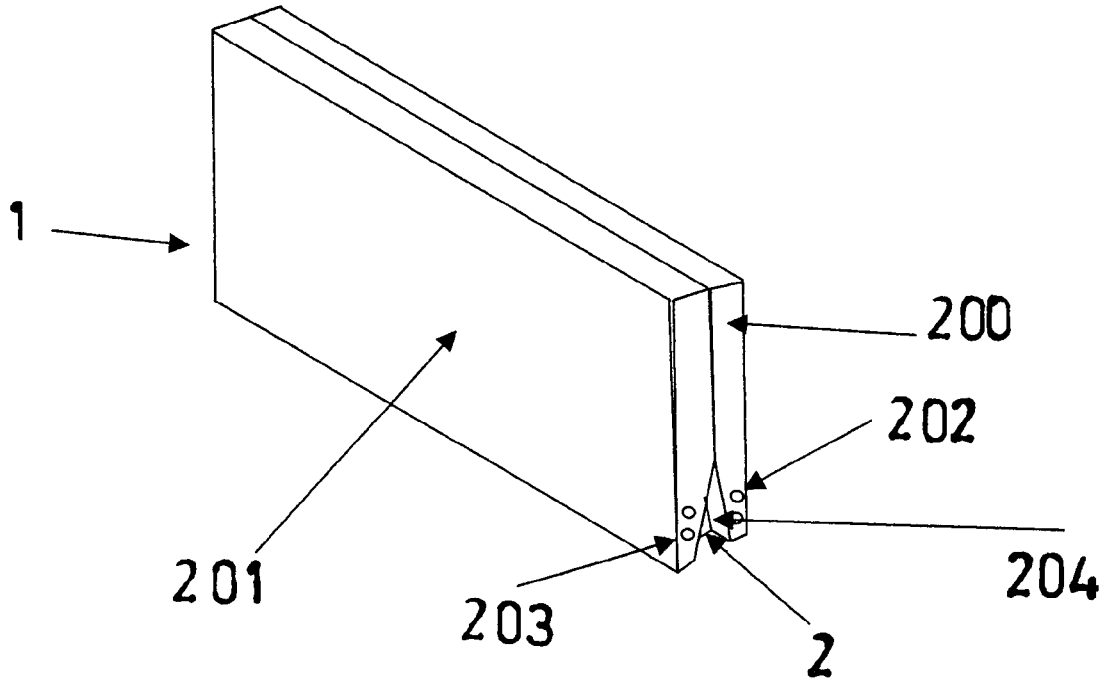
FIG. 1—Is a perspective view of the current invention in the "retracted" and "closed" position.

FIG. 1, shows the present invention in the "closed" and "contracted" position, illustrating the base support (1) having two short sides (200) and one long side (201) and the lower portion (2). The base support further including upper section tabs (202) and lower section tabs (203).

Figure 2:
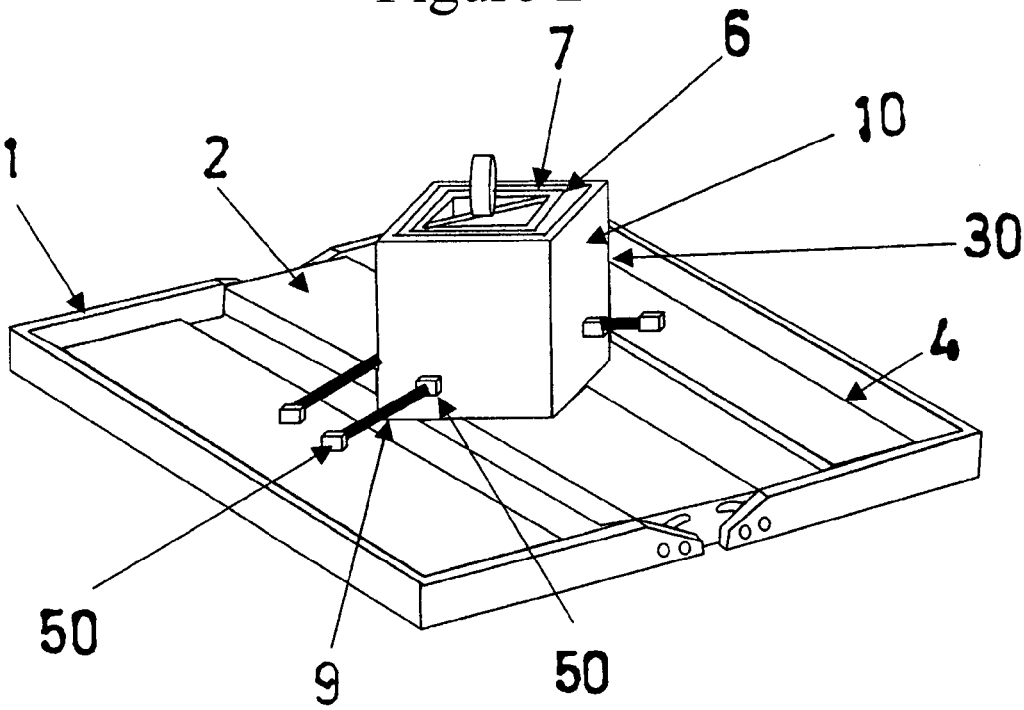
FIG. 2—Is a side view of the current invention in the "retracted" and "open" position.

FIG. 2, illustrates the present invention in the "open" and "contracted" position. By rotating the base supports (1) about the lower portion (2), the "ball-in-socket" design (50) and the lower linkages (9) effectively pull the lower (10), middle (6) and upper (7) rectangular shaped hollow vertical risers from an (10,6,7) from a relatively "flat" shape when stored to an "open" hollow shape. When the device is readied for storage, the base supports (1) are rotated about the lower portion (2) and the lower linkages (9) effectively push the lower, middle and upper rectangular shaped hollow vertical risers (10,6,7) from an "open" hollow shape to a relatively "flat" shape when the base support (1) is fully "closed".

Figure 3:
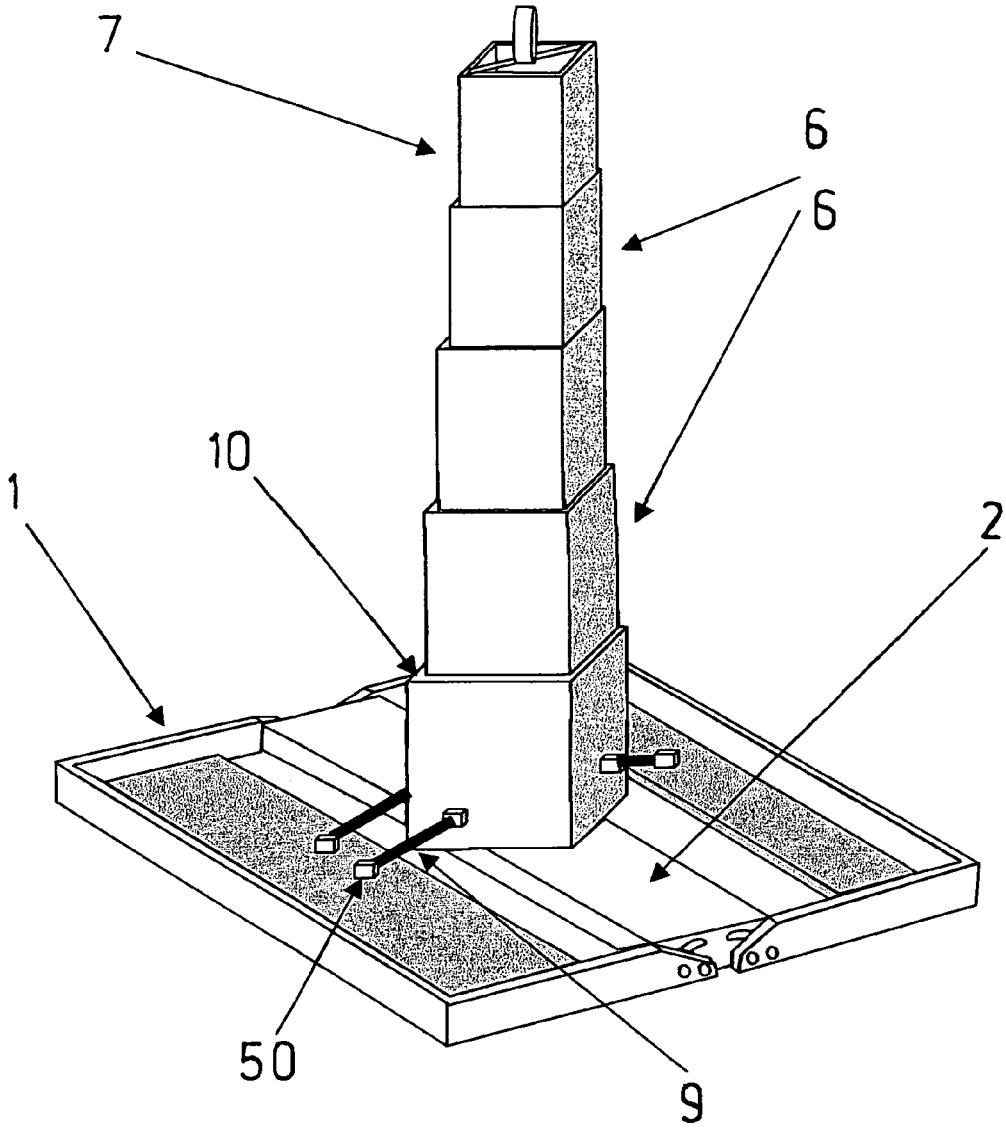
FIG. 3—Is a perspective view of the current invention in the "expended" and "open" position.

FIG. 3 shows the present invention in the "open" and "expanded" position, illustrating the lower, middle and upper rectangular shaped hollow vertical risers (10,6,7) in the fully extended position.

Figure 4:
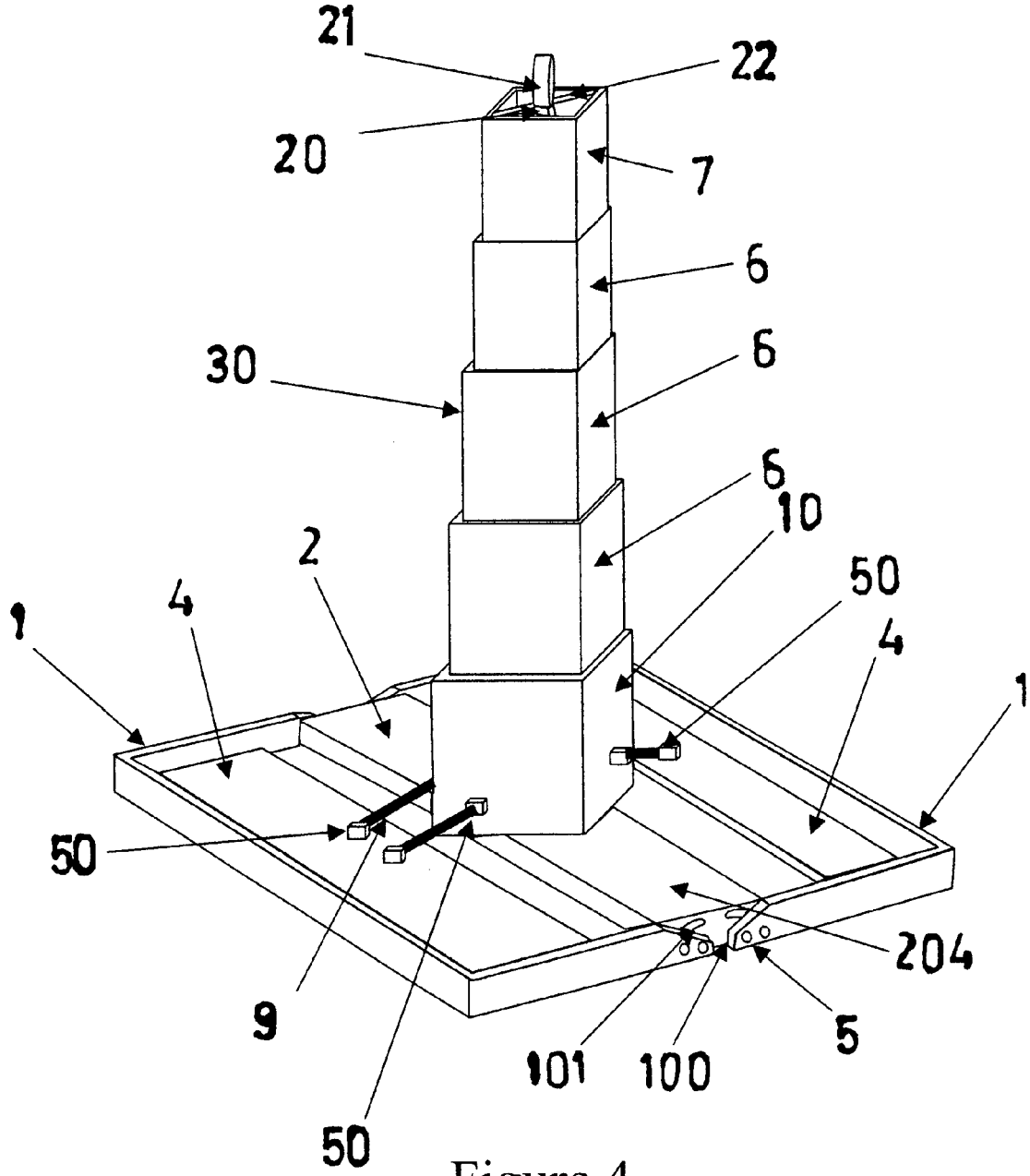
FIG. 4—Is a perspective view of the current invention in the "expended" and "open" position illustrating reference numerals.

Referring to FIG. 4, the lower portion (2), contains a series of holes (100) and slots (101) that allow for the base supports (1) to be attached by use of the "protruding" tabs (5). Attached to the top side (204) of the lower portion (2) retractable arm (20) consisting of several sections that fit within each other. Contain within the base supports (1) are support weights (4). These support weights (4) are designed to help the total sign support structure resist displacement under high wind conditions. Also contained between the base supports (1) and the lower portion (2) are lower linkages (9) that allow for movement of the "flexible hinges" (30) on the lower, middle and upper rectangular shaped hollow vertical risers (10,6,7) that allow its shape to change from a relatively "flat" to a "trapezoidal" or "rectangular" hollow shape. The lower linkage (9) is connected by a "ball-in-socket" type design (50) to the base support (1) and the lower vertical riser (10). Contained within the lower vertical riser (10) is a series of middle vertical risers (6) capable of extending into a fixed position when the upper vertical riser (7) is extended to its maximum height by lifting the retractable arm (20). The upper rectangular shaped hollow vertical riser (7) is connected to the retractable arm (20) by an upper linkage (22) that allows for the lifting of the lower, middle and upper rectangular shaped hollow vertical risers (10,6,7) when the retractable arm (20) is extended. The retractable arm (20) is extended into a fully vertical position by lifting the handle (21).

Figure 5:
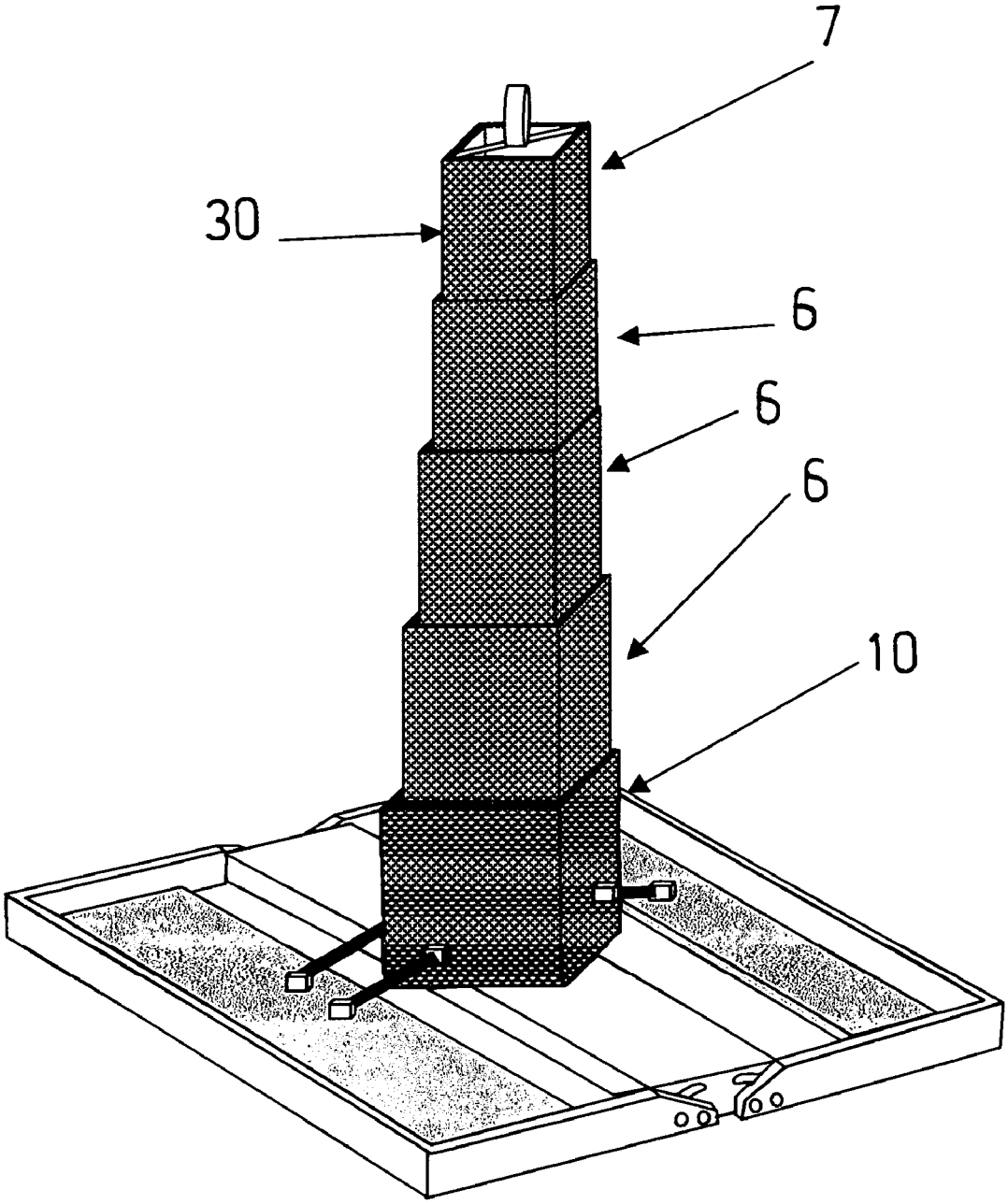
FIG. 5—Is a perspective view of a second embodiment of the invention in the "expended" and "open" position illustrating the "air-flow" holes in the series of vertical risers.

A second embodiment of the invention is illustrated in FIG. 5. As illustrated in the figure, lower, middle and upper rectangular shaped hollow vertical risers (10,6,7) may be designed with "air-flow" holes (205) as to reduce the overall wind load on the structure.

Figure 6:
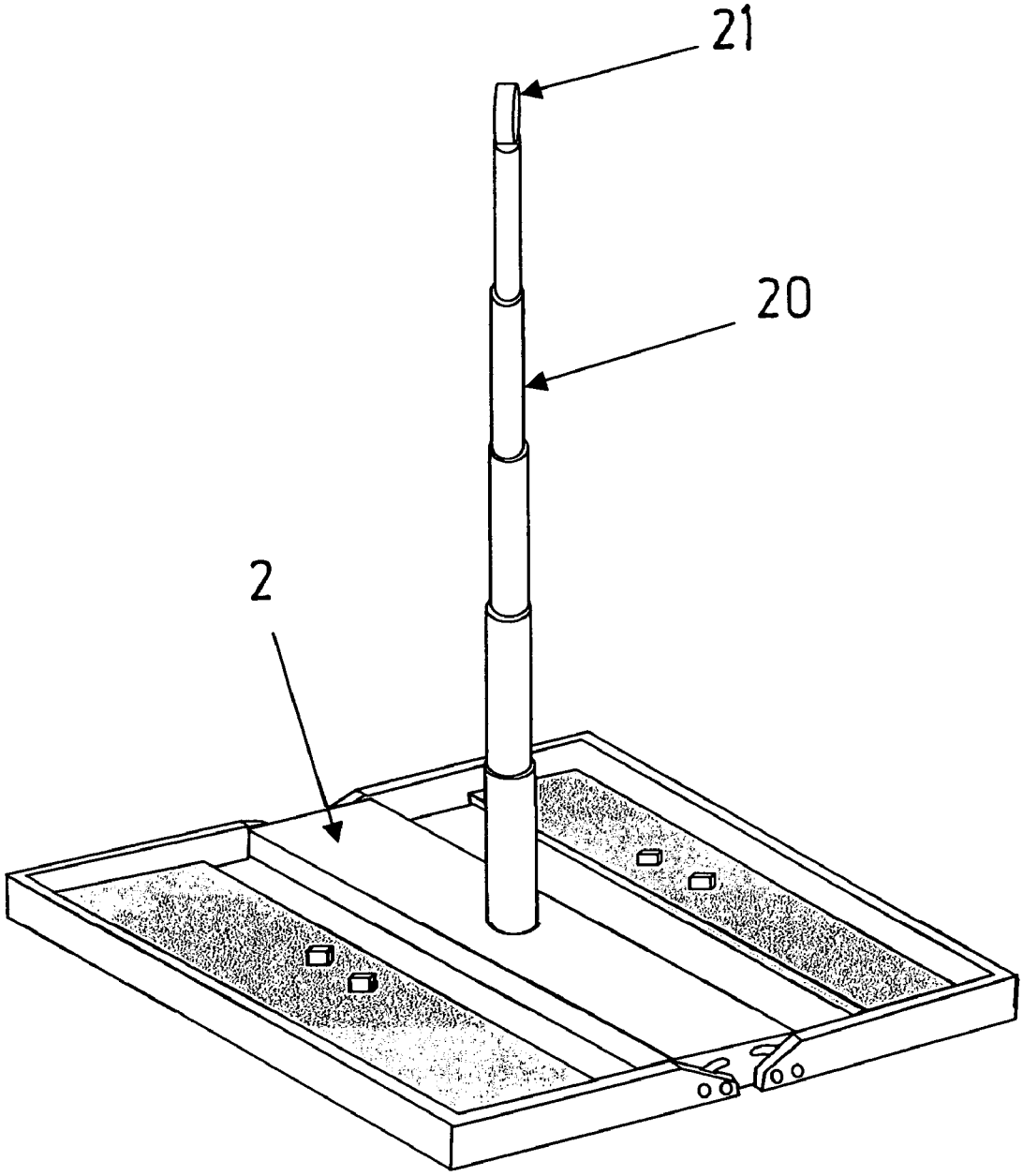
FIG. 6—Is a perspective view of the current invention in the "expended" and "open" position without the vertical risers illustrating the retractable arm.

FIG. 6 illustrates a third embodiment of the present invention, in the open and expanded position without the vertical risers and is intended to show the placement of the retractable arm (20) in relation to the base supports (1) and the lower portion (2).

Figure 7:
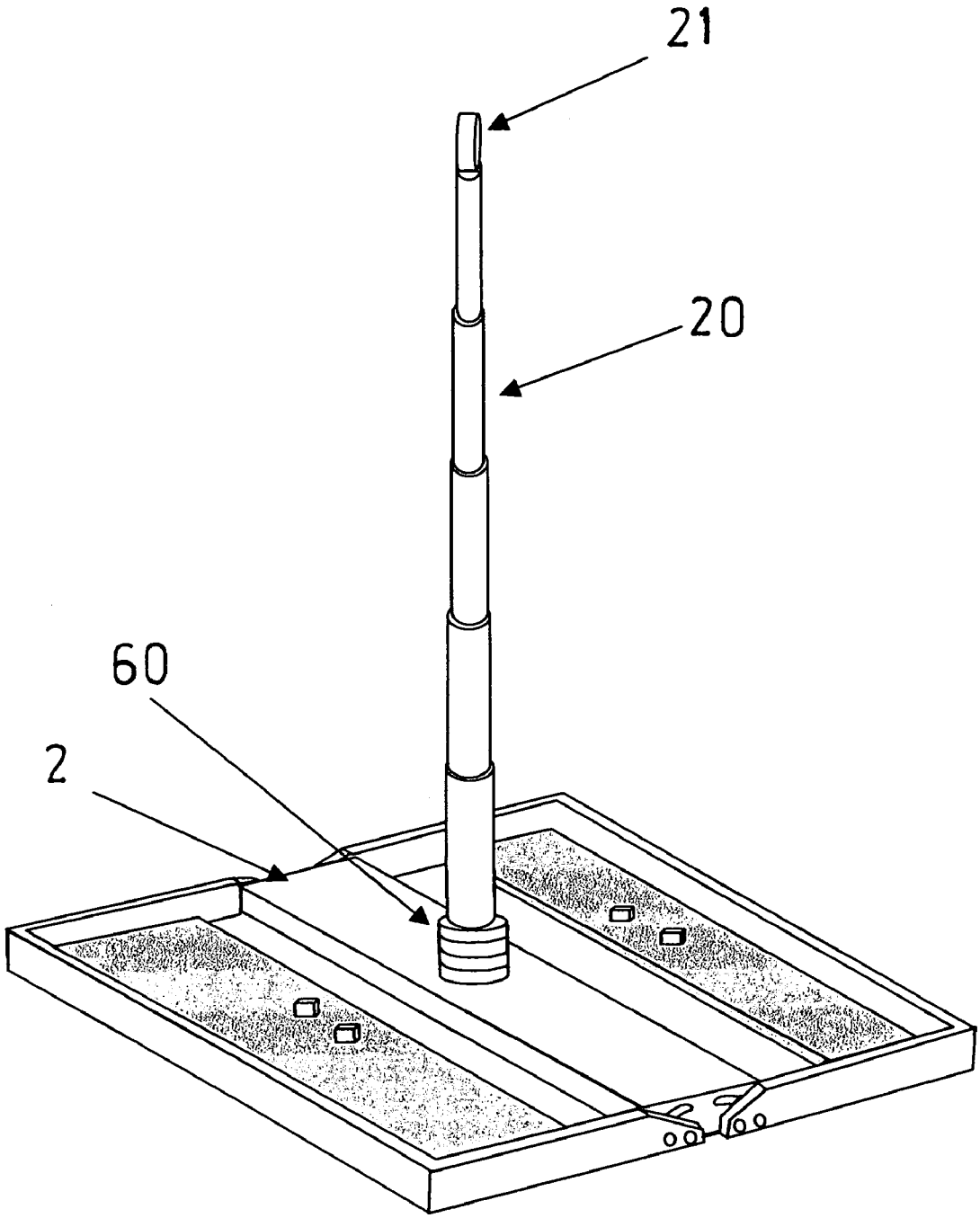
FIG. 7—Is a perspective view of a third embodiment of the invention in the "expended" and "open" position without the vertical risers illustrating the spring design of lower portion of the retractable arm.

A fourth embodiment of the invention is illustrated in FIG. 7, the lower portion of the retractable arm (20) may be designed in the shape of a spring (60) to allow for greater flexibility of the device. This flexibility would allow for temporary slight displacement of the lower, middle and upper rectangular shaped hollow vertical risers (10,6,7) under high wind conditions, thus reducing the necessary weight of the support weights (4).

To deploy the current invention, the user simply rotates the two base supports (1) about the lower portion (2) into a locked position perpendicular to the retractable arm (20), and then lifts the lower, middle and upper rectangular shaped hollow vertical risers (10,6,7) into a locked vertical position by use of the handle (21) on the upper portion of the retractable arm (20). The device is now ready for use.

What is claimed:

1. A condensed retractable traffic cone device, comprising:

two separate base supports that are rectangularly shaped; each base support having a bottom with no top, two short sides and a long side; the short sides of the base support containing upper and lower section tabs on the side adjacent to the open side of each base support;

wherein a lower portion is comprised of a rectangular flat bottom section having holes and slots on each side allowing the lower section tabs of the two separate base supports to be inserted into the holes of the lower portion and allowing the upper section tabs of the two separate base supports to be inserted into the slots of the lower portion allowing rotation of the base supports about the lower portion;

wherein a retractable arm is comprised of flexible upper, middle and lower tapered hollow vertical risers having a rectangular shape and that fit within each other;

wherein the lower hollow vertical riser of the retractable arm is affixed to the top side of the lower portions;

wherein the upper hollow vertical riser of the retractable arm has a handle affixed to its top and has a pair of upper linkages affixed to the top of the upper hollow vertical riser;

wherein the lower hollow vertical riser has a series of ball and socket connectivities located on opposite sides;

wherein a series of lower linkages connect the ball and socket connectivities of the lower hollow vertical riser to the base supports;

wherein a series of middle hollow vertical risers are designed to fit within each other with the upper hollow vertical riser located at the top of the series of middle risers and the lower hollow vertical riser is located at the bottom of the series of middle risers;

wherein the flexible upper, middle and lower rectangularly shaped risers are retracted within each other and the base supports are rotated about the lower portion transforming the device into a relatively flat storage position comprising a rectangular shape when not in use.

2. The device of claim 1, wherein the flexible lower, middle and upper vertical rectangularly shaped risers are designed with "air-flow" holes.

* * * * *